US005127248A

United States Patent [19]

Sansèau et al.

[11] Patent Number: 5,127,248

[45] Date of Patent: Jul. 7, 1992

[54] PROCESS AND DEVICE FOR PIPE BENDING

[75] Inventors: Paul R. Sansèau, Cherbourg; Pierre M. Vidal, Orly Sud, both of France

[73] Assignee: Etat Francais represente par le Delegue General, Paris, France

[21] Appl. No.: 711,063

[22] Filed: Jun. 6, 1991

[30] Foreign Application Priority Data

Jun. 8, 1990 [FR] France ..... 90 06559

[51] Int. Cl.[5] ..... B21D 7/04

[52] U.S. Cl. ..... 72/149; 72/157

[58] Field of Search ..... 72/149, 150, 154, 157, 72/159, 214, 215, 216, 217, 459

[56] References Cited

U.S. PATENT DOCUMENTS

| | | | |
|---|---|---|---|
| 1,714,083 | 5/1929 | Frank | 72/154 |
| 3,584,492 | 6/1971 | Dodge | 72/154 |
| 4,416,136 | 11/1983 | Schwarze | 72/157 |
| 4,537,053 | 8/1985 | Schwarze | 72/159 |

FOREIGN PATENT DOCUMENTS

| | | | |
|---|---|---|---|
| 0338944 | 10/1989 | European Pat. Off. . | |
| 1950127 | 10/1969 | Fed. Rep. of Germany . | |
| 2085483 | 12/1971 | France . | |
| WO87/01625 | 3/1987 | PCT Int'l Appl. . | |
| 1189520 | 11/1985 | U.S.S.R. | 72/214 |

*Primary Examiner*—Lowell A. Larson
*Assistant Examiner*—Michael J. McKean
*Attorney, Agent, or Firm*—Oliff & Berridge

[57] ABSTRACT

A pipe bending die, in the shape of a cylinder, has a groove gouged out of its lateral surface and a cross section which is a semi-circle of a diameter equal to the diameter of the pipe to be bent. The base of the cylinder is bounded on one hand by a portion of logarithmic spiral defined in polar coordinates by the equation $P=Poe^{-k\theta}$, bounded by the points $\theta=0$ and $\theta=2\pi$, and wherein Po and k are positive constants and, on the other hand, by a segment of straight line joining the points of the spiral for which $\theta=0$ and $\theta=2\pi$.

6 Claims, 3 Drawing Sheets

PROCESS AND DEVICE FOR PIPE BENDING

BACKGROUND OF THE INVENTION

The present invention relates in general to a pipe bending machine, and in particular to bending of pipes. To be more precise, the invention relates to pipe bending dies and the procedure for the use of the bending die according to the invention.

To bend a pipe through a bend angle $\beta$, a bending die mounted on a bending machine is used. Such bending dies are in the shape of cylinders whose basic surface is a circle and whose lateral surface comprises a groove whose cross section is a semi-circle with a diameter equal to the external diameter of the pipe to be bent. The pipe is applied to the bending die at the groove in the lateral surface and the pipe is turned through an angle greater than $\beta$, equal to $(\beta+\alpha)$ since it is known that after removal of the bending force it undergoes an elastic deformation which tends to reduce the bend. In the rest of this document, the desired permanent bend will be denoted $\beta$ and the extra bending i.e. the extra angle through which the pipe must be turned around the bending die to obtain the permanent bend $\beta$ will be denoted $\alpha$. For all useful purposes, it shall be remembered that the bend of a pipe is the angle formed by the neutral axes of two straight consecutive parts of a pipe, the neutral axis itself being the geometric locus of the centres of the cross sections of the pipe. The bending radius is the radius of the circumferential arc of the neutral axis contained between two consecutive straight parts. The curve described by the neutral axis between two straight parts may not be a circumference; in this case the average bending radius R will be defined by the relationship $S/\beta$ in which S is the length of the curve contained between straight parts and the bending. When a pipe is bent on a circular die of radius R, it is wound as explained above through an angle greater than angle $\beta$, the winding angle then being $\beta+\alpha$. In this was the bending radius after elastic deformation is greater it becomes:

$$R + \Delta R = \frac{\beta + \alpha}{\beta} \cdot R = R\left(1 + \frac{\alpha}{\beta}\right)$$

The result of this is that if it is desired to bend a pipe accurately through an angle $\beta$, with the bending radius being R, a bending die smaller than R must be used. The extra bend $\beta$ is itself an increasing function of angle $\beta$ in such a way that the greater the desired angle of bend, the smaller the radius of the bending die to be used must be in order to keep the same bending radius. This phenomenon being known, until now sets of bending dies have been used for each bending radius and, for example one can, in order to obtain a given radius R for bends between 0° and 30°, use a circular bending die of R1 so that R1<R, then in order to bend through between 30° and 60° a bending die of R2, R2<R1 and so on until the complete range of desired bends is obtained. The radii R1, R2 of bending dies that are used for the various sub-ranges are determined by experimentation on representative samples of the pipes that are to be bent.

The prior art, as has just been described, is illustrated by FIGS. 1 and 2.

On FIG. 1 can be seen a circular bending die 1 on which by means of a clamping jaw 2 pipe 3 is applied.

The latter is wound by means of clamping jaw 2 through an angle $(\beta+a)$ 4 equal to angle 5 which between them make the segments of neutral axes 6 situated on either side of the bend.

FIG. 1 illustrates the first phase in pipe forming, the second phase then consists of moving the pipe forward by length $\Delta L$ possibly turning it on itself, in order to perform parbuckling, then performing the following bend with possible changing of the bending die, if the desired bending angle for the following bend requires a bending die with a different radius.

FIG. 2 illustrates the new position of the pipe at the end of phase 2 and in this can basically be seen pipe 3 and its neutral axis 6 comprising two segments, on either side of the bend. Due to the fact of elastic deformation, these two segments between them form an angle 7 that is in theory equal to $\beta$ if the extra bend has been correctly chosen.

This prior art has two disadvantages: on the one hand it means a change in the bending die every time there is a change from one bending range to another, on the other hand it allows an error on the bending radius and/or the bending to remain due to the fact that the changes in the bending die radius (R1, R2 etc.) are discontinuous ones. This error can be a large one and may be unacceptable in the case of pipes intended to be housed in large number in cramped locations such as the hulls of submarines. Part of the error originates in the bending tool, the circular bending die, whose radius only changes in stages, and part originates in not knowing the extra bends a that need to be applied.

SUMMARY OF THE INVENTION

The object of the invention is to remedy the aforementioned disadvantages by means of a bending die whose average bending radius is continuously variable and, by means of a procedure for use for the said bending die that enables bends to be made for which the required extra bends are better estimated.

For this purpose, the object of the invention is a pipe bending die in the shape of a cylinder from whose lateral surface a groove is gouged whose cross section is a semi circle of diameter equal to the diameter of the pipe to be bent, characterized in that the base of the cylinder is bounded, on the one hand by a portion of logarithmic spiral defined in polar coordinates by the equation $P = Po\, e^{-k\theta}$ (1), portion bounded by the points $\theta=0$ and $\theta=2\pi$, and in which Po and k are positive constants, and, on the other hand, by a segment of straight line joining the points of the spiral for which $\theta=0$ and $\theta=2\pi$.

The curve of equation (1) is a logarithmic spiral. A property of this curve is that the bending radius steadily and continuously reduces by the value $R1 = Po\sqrt{1+k^2}$ where $\theta=0$ at the value $R2 = Po\sqrt{1+k^2}\, e^{-k2\pi}$ when $\theta=2\pi$. A bending die with this circumference therefore offers the opportunity to obtain average bending radii for the bending of pipes, that are continuously variable between two limits contained in the gap between R1 and R2.

If the limits R1 and R2 are correctly chosen, it shall always be possible to find on the spiral a portion contained between two radius vectors forming between them the angle $\beta+a$ and such that the average bending radius of this portion is equal to $$R - \Delta R = \frac{\beta}{\beta + \alpha} R$$

in such a way that after removal of the bending force through an angle a, the bending radius is exactly equal to R.

BRIEF DESCRIPTION OF THE DRAWINGS

Other characteristics and advantages of the invention will emerge from the following disclosure made with reference to the appended drawings wherein.

DESCRIPTION OF PREFERRED EMBODIMENTS

Figure 1:
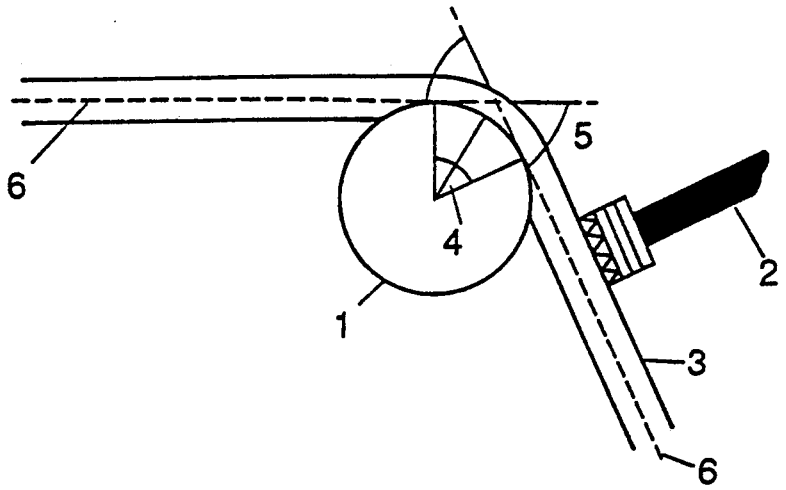
FIG 1 PRIOR ART
FIG. 1 illustrates the first phase in pipe bending in accordance with the prior art described above.
Figure 2:
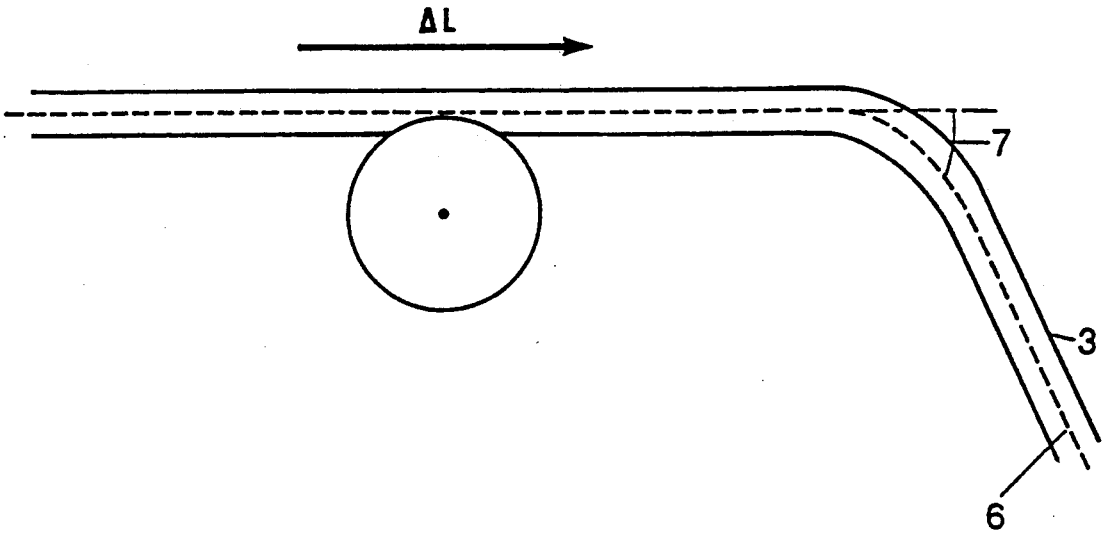
FIG 2 PRIOR ART
FIG. 2 illustrates the position of the pipe at the end of the pipe bending in accordance with the prior art described above.
Figure 3:
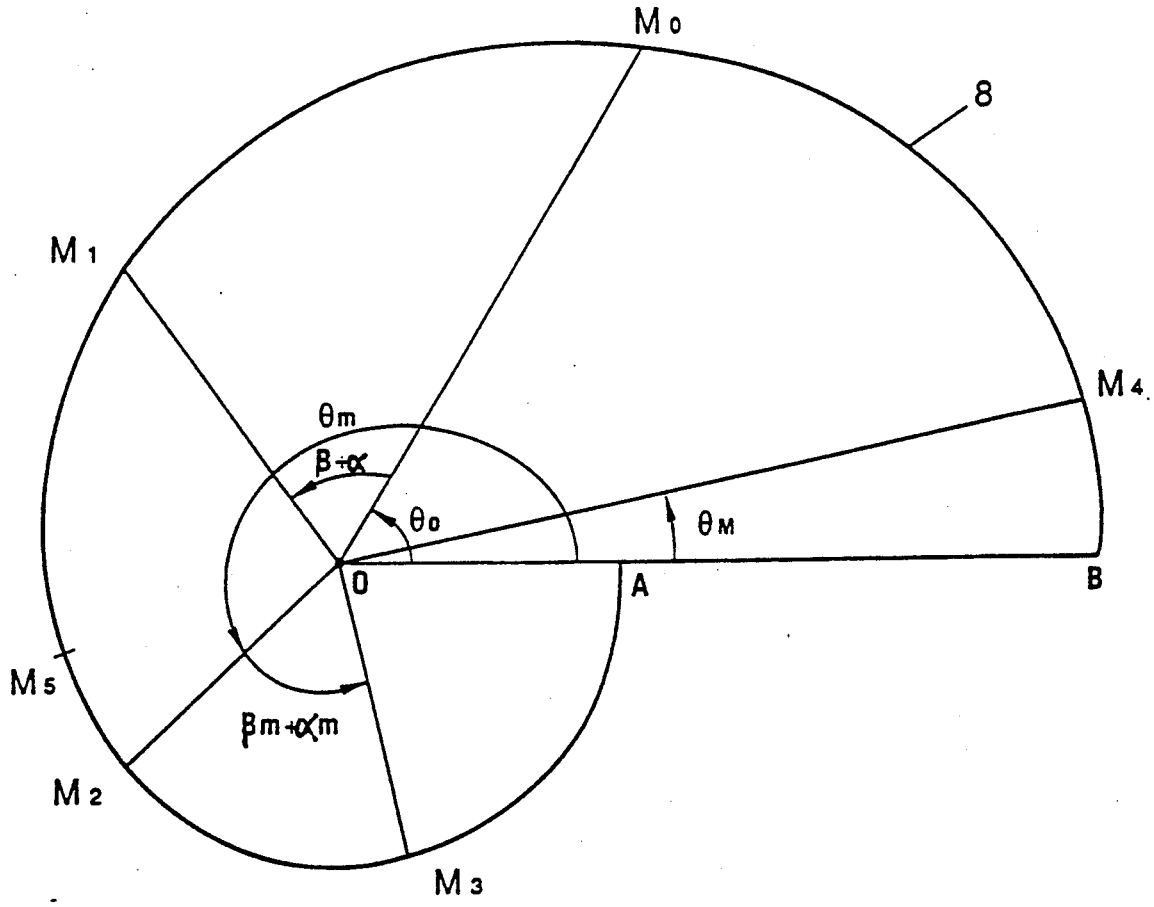
FIG. 3 represents a logarithmic spiral and is intended to illustrate the principle, the advantages of the invention and the method for determining the dimensions of the bending die as a function of the characteristics of the pipes to be bent.

FIG. 3 represents a portion of the logarithmic spiral (8) according to the equation:

$$P = Po\, e^{-k\theta} \quad (1),$$

It goes from point B to point A when angle E varies from 0 to $2\pi$.

The centre of the polar coordinates is represented by the point 0.

Po is equal to OB

P1 is equal to OA

Po being determined, P1 is a function of the coefficient k.

The circumference of the bending die shall be completely determined when Po and k have been established. Below the method of proceeding is examined:

first of all on a representative range of samples of pipes of diameter D that are to be bent on the bending die, the extra bends $\alpha$, corresponding to the desired bends $\beta$ are determined. For bending radii between 2.5 D and 3 D (the most common situation). It can be noted that the extra bending may be determined by the linear equation:

$$\beta = a + b\beta$$

where a and b are constants. For example, for a pipe of diameter 30 mm, "a" may be between 1° and 6° and "b" may vary between 0.02 and 0.05. It is worthwhile noting that for the rest of the disclosure that a and b are average values for a single category of pipes made from the same material. These values are included between two limit values a1, a2 and b1, b2. These limit alues may be quite far apart from each other, and the value to be used to carry out a particular bend is not known a priori.

These values vary along a single pipe due to the lack of homogeneity in the material and especially on account of the variable roundness of the pipe. The fact that the bending die can provide continuous variation in the bending radius, and therefore greater accuracy at the bending radius, makes both possible and advantageous a procedure, which will be disclosed later on, using the results obtained on previous bends in order to carry out the following bending operation.

The ranges a1, a2—b1, b2 and the average values a and b being known, Po and k are determined by calculation in the following way:

let R be the desired bending radius. We know that:

$$R = S/\beta \quad (2)$$

In this equation S is the length of the arc of spiral MoM1 (FIG. 3) contained between the radius vectors determined by angles $\theta o$ and $(\theta o + \beta + \alpha)$.

The length of MoM1 is for a given angle $\beta$ a function of Po, k, and also of $\theta o$, which determines the point of the spiral from which one starts to bend. When Po and k are fixed, i.e. when a specific bending die is used, the length of MoM1 is now only a function of $\theta o$. It is therefore appropriate to check when establishing Po and k that the equation (2) will always have a solution in $\theta o$ such that the corresponding point Mo is correctly on a point of the curve 8, i.e. that a solution $0 < \theta o < 2\pi$ is necessary. This simple condition is not sufficient, it is again necessary that starting from the point Mo defined by the angle $\theta o$, it is possible to bend through an angle $(\beta + a)$ while remaining the length of the curve (8). This condition shall always be implemented for large bend angles for which it is always worthwhile to choose small initial bend angles, i.e. near to $\theta = 0$.

On the other hand, for small bend angles it will be necessary for Eo to meet the condition:

$$\theta o < 2\pi - (\beta_m + \alpha_m + \delta)$$

which $\delta$ is defined by the fact that the angle $2\pi - \delta$ corresponds to the point M6 of the curve 8, point for which the tangent to the curve 8 passes through point B. (For the simplicity of the drawing this point has been represented on FIG. 4. The introduction of the angle $\delta$ is necessary in order to not be hampered by the discontinuity of the curve 8 near to $\theta = 0$.

One therefore proceeds in the following way: the desired minimum bend $\beta m$ is known, to this bend corresponds an extra bend $\alpha m$ and an initial bend angle $\theta m$. The points of the spiral 8 corresponding to $\theta m$ and $(\theta m + \beta m + \alpha m)$ are represented by M2 and M3. The desired maximum bend is also known i.e. m to which corresponds an extra bend at am and an initial bend angle $\theta m$. The points of the spiral 8 corresponding to angles $\theta m$ and $(\theta m + \alpha m + \beta m)$ are represented by M4 and M5. For both values of $\beta$, the equation (2) below becomes, by calculating M2M3 and M4M5 according to traditional methods, $$R = \frac{1}{\beta_m} \frac{\sqrt{1 + k^2}}{k} Po\, e^{-k\theta m}(e^{-k(\beta m + \alpha m)} - 1)$$

$$R = \frac{1}{\beta_M} \frac{\sqrt{1 + k^2}}{k} Po\, e^{-k\theta M}(e^{-k(\beta M + \alpha M)} - 1)$$

The division of these 2 equations element by element leads to an equation (6) where only k now appears:

$$1 = \frac{\beta m}{\beta M} e^{-k(\theta M - \theta m)} \frac{e^{-k(\beta M + \alpha m)} - 1}{e^{-k(\beta m + \alpha m)} - 1} \quad (6)$$

Coefficient k is small because the spiral necessary using the usual extra bend values is almost a circle. Under these conditions the first degree of the limited development of the expression $e^x$ i.e. $e^x$ is approximately equal to $(1+x)$, can be used.

With this approximation is obtained:

$$k = \frac{1}{\theta M - \theta m}\left(1 - \frac{\beta m + \alpha m}{\beta M + \alpha M} \cdot \frac{\beta M}{\beta m}\right) \quad (7)$$

$\theta$M is the initial bend angle for maximum bending $\beta_M$. For large angles $\Delta$R is small, one is therefore near to the large radius vectors of the spiral, therefore near to angles neighbouring on 0, $\theta$m will have to be small, the only criteria to be considered is to not be hampered by the discontinuity of the curve 8 for $\theta=0$.

$\theta$m is the initial bend angle for minimum bending, and therefore corresponds to bending radii of the small bending die. $\theta$m will therefore have to be as large as possible but nevertheless less than $(2\pi-(\beta m+\alpha m+\delta))$ in such a way that it is possible to bend through the angle $(\beta m+\alpha m)$ without being hampered by the discontinuity of curve 8 near to $\theta=0$.

By taking as an example $\theta_M = 0.1$ radian
$\beta_m = \pi/8$ radian
$\beta M = \pi$ radian
$\theta m = 2\pi - (0.1 + \pi/8 + \alpha m)$
$\delta = 0.1$ radian The following values for k as a function of a and b are obtained.

| | a | | | | | |
|---|---|---|---|---|---|---|
| b | 6° | 5° | 4° | 3° | 2° | 1° |
| 0.02 | 0.037 | 0.030 | 0.023 | 0.018 | 0.011 | 0.007 |
| 0.03 | 0.037 | 0.030 | 0.022 | 0.019 | 0.011 | 0.006 |
| 0.04 | 0.037 | 0.030 | 0.022 | 0.019 | 0.011 | 0.006 |

The value of Po is obtained by transferring of the value for k to one of the equations (4) or (5)

For $\theta m = 0.1$ radian
$\beta_M = \pi$ radian and $k = 0.03$ one finds $Po = 0.97\ R$ and
$P1 = 0.82$ Po It can be seen that Po hardly differs from R, Po=R can therefore also be established and k determined by establishing the minimum value for the bending value that will be created on the bending die by replacing Po with R in equation (4) above.

Figure 4:
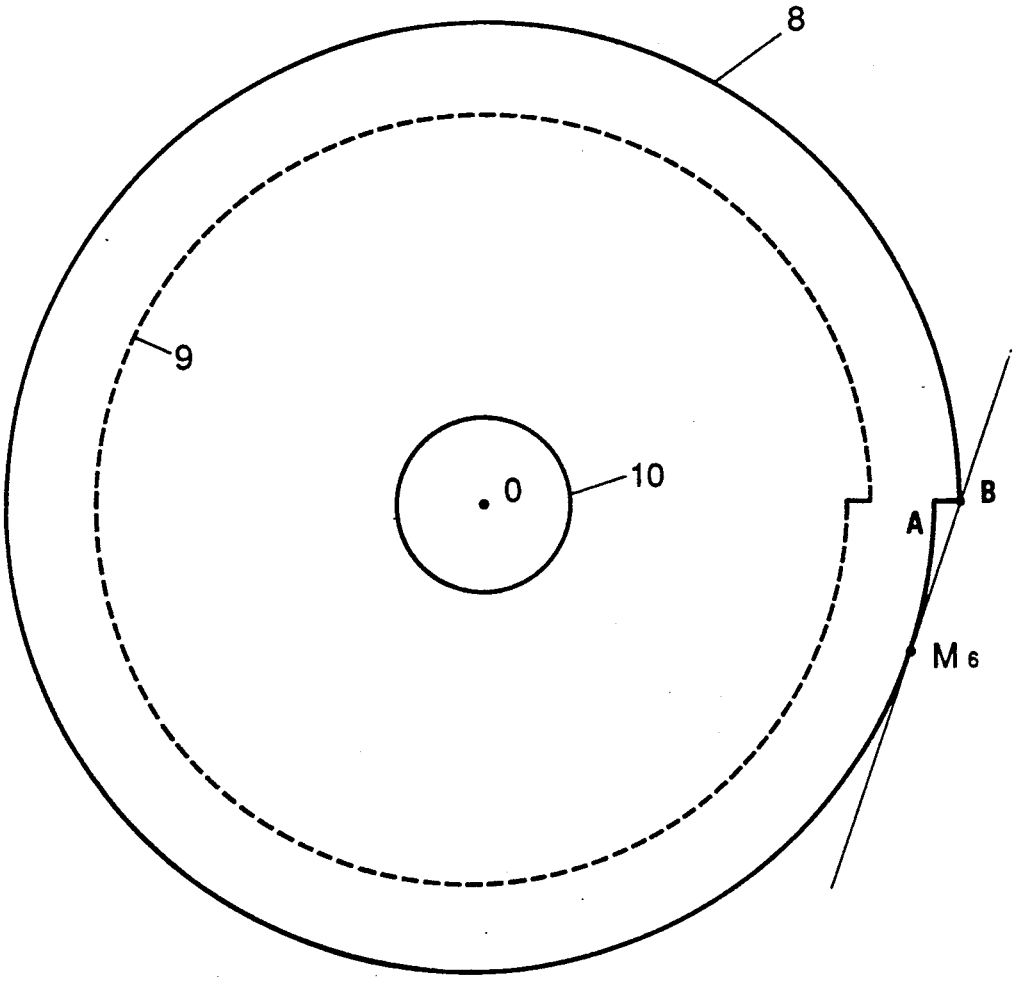
FIG. 4 is a plan view of a particular example of bending die embodied according to the invention.
Figure 5:
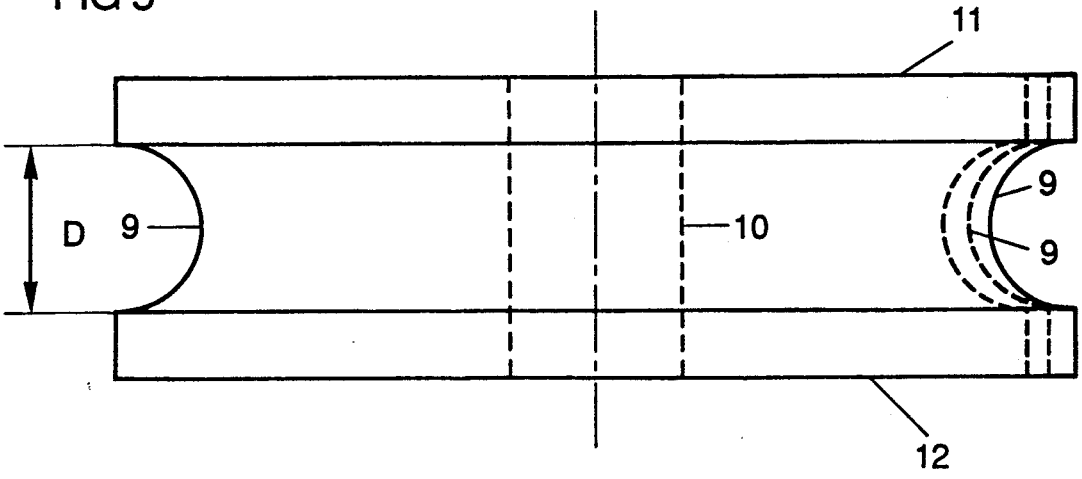
FIG. 5 is a side view of the same particular example.

The particular embodiment represented in the plan view FIG. 4 and in side view FIG. 5 was created according to this latter method.

This is a bending die intended to bend pipes of diameter D=30 mm with a bending radius R=2.9 D i.e. 87 mm. This is therefore the value chosen for Po of spiral 8. This bending die enables pipes for which a is contained between 1° and 2°, b varying from 0.01 to 0.05 to be bent. Coefficient k being in this case equal to 0.008. Groove 9 hollowed out of the lateral surface is also spiral in shape.

Borehole 10 is intended to be fitted onto a bending machine in the conventional manner. The opposite faces 11 and 12 comprise angular graduations that are not shown.

The values in cm of the radius vector of spiral 8 are given below for values of $\theta$ from 0° to 350° for each step of 10°. The values of the radius vector corresponding to the bottom of the groove are deduced from the first ones by subtracting 1.5 cm.

| Angle $\theta$ in degrees | Radius vector of the spiral P in cm |
|---|---|
| 0 | 8.70 |
| 10 | 8.68 |
| 20 | 8.67 |
| 30 | 8.66 |
| 40 | 8.64 |
| 50 | 8.63 |
| 60 | 8.62 |
| 70 | 8.61 |
| 80 | 8.59 |
| 90 | 8.58 |
| 100 | 8.57 |
| 110 | 8.55 |
| 120 | 8.54 |
| 130 | 8.53 |
| 140 | 8.52 |
| 150 | 8.50 |
| 160 | 8.49 |
| 170 | 8.48 |
| 180 | 8.47 |
| 190 | 8.45 |
| 200 | 8.44 |
| 210 | 8.43 |
| 220 | 8.42 |
| 230 | 8.40 |
| 240 | 8.39 |
| 250 | 8.38 |
| 260 | 8.37 |
| 270 | 8.36 |
| 280 | 8.34 |
| 290 | 8.33 |
| 300 | 8.32 |
| 310 | 8.31 |
| 320 | 8.29 |
| 330 | 8.28 |
| 340 | 8.27 |
| 350 | 8.26 |

The following is the procedure for using this bending die: Having determined by sampling the coefficient a and b related to the pipes that are to be bend as well as their stages of variation a1 a2, b1 b2, a table is drawn up giving for every value of B the angle $\alpha 1+\beta 1$
the initial bending angles $\theta 1$
the final bending angle $\theta 1+\alpha 1+\beta 1$
the variation ranges for each of these three angles.

The bending die being graduated in the same unit as the table, the pipe is wound on the bending die starting from angle $\theta 1$, up to angle $\theta 1+\beta 1\ \alpha 1$. In this way the neutral axis of the pipe has correctly turned through the angle $\beta 1+\alpha 1$, since a property of the spiral is that the tangent at a point of the spirals forms with the corresponding radius sector a constant angle.

After removal of the bending force the error $\Delta\beta 1$ is measured, this error is used if it is negative in order to correct by addition of $\Delta\beta 1$, the bending which has just been carried out and in all cases to refine the value for the subsequent extra bending $$\Delta\beta 2 = \Delta\beta 1 \frac{\beta 2}{\beta 1}$$

For the following bending operation, the correction made to $\beta 3$ will be deduced by linear extrapolation of the errors noted during the two previous bending operations.

We claim:

1. Pipe bending die having one superior, one inferior and one lateral surface, the lateral surface being gouged with a groove whose cross section is a semi-circle of diameter equal to the diameter of the pipe to be bent, the circumferences of the superior surface and the inferior surface being identical and having a first part spiraling logarithmically, the logarithmic spiral being defined, in polar coordinates and between the boundaries $\theta=0$ and $\theta=2\pi$, by an equation of the form $P=Poe(-k\theta)$, in which Po and k are positive constants and having a second part which is a segment of straight line joining the points of the spiral for which $\theta=0$ and $\theta=2\pi$.

2. Bending die according to claim 1 characterized in that the value of the coefficient k is determined as a function of the formula:

$$k = \frac{1}{\theta_M - \theta_m}\left(1 - \frac{\beta_m + \alpha_m}{\beta_M + \alpha_M} \cdot \frac{\beta_M}{\beta_m}\right)$$

wherein k is determined as a function of:

required bending angles $\beta m$ and $\beta M$;

corresponding extra bending angles $\alpha m$ and $\alpha M$ necessary for the pipe springing back compensation after bending force removal; and chosen corresponding initial bending angles $\theta m$ and $\theta M$, $\theta M$ being small but not null and $\theta m$ being as large as possible but nevertheless less than $(2\pi-(\beta m+\alpha m+\delta)$ where $\delta$ is introduced to be unhampered by the second part of the circumference.

3. Bending die according to claim 2 characterized in that the value for Po is determined by the equation $$R = \left| \frac{1}{\beta_m} \frac{\sqrt{1+k^2}}{k} Po\, e^{-k\theta m}(e^{-k\theta m+\alpha m} - 1) \right|$$

in which R represents the desired bending radius.

4. Bending die according to claim 1 characterized in that the modulus Po is equal to the desired bending radius R.

5. Bending die according to claim 4 characterized in that the coefficient k is determined by the formula $$1 = \frac{1}{\beta_m} \frac{\sqrt{1+k^2}}{k} e^{-k\theta m}(e^{-k(\beta m+\alpha m)} - 1)$$

6. A bending procedure using a pipe bending die having one superior, one inferior and one lateral surface, the lateral surface being gouged with a groove whose cross section is a semicircle of diameter equal to the diameter of the pipe to be bent, the circumferences of the superior surface and the inferior surface being identical and having a first part spiraling logarithmically, the logarithmic spiral being defined, in polar coordinates and between the boundaries $\theta=0$ and $\theta=2\pi$, by an equation of the form $P=Poe(-k\theta)$, in which Po and k are positive constants having a second part which is a segment of straight line joining the points of the spiral for which $\theta=0$ and $\theta=2\pi$, comprising the steps of:

performing a series of bending operations;

determining and recording errors in the bends formed by the bending operations; and correcting subsequent bending by linear extrapolation of the errors.

* * * * *